US005642951A

United States Patent [19]

Belizario

[11] Patent Number: 5,642,951

[45] Date of Patent: Jul. 1, 1997

[54] ADJUSTABLE CONTINUOUS FEED PRINTER PAPER COLLECTION DEVICE

[76] Inventor: Efren Belizario, 32 Carlson Pkwy., Cedar Grove, N.J. 07009

[21] Appl. No.: 603,993

[22] Filed: Feb. 20, 1996

[51] Int. Cl.[6] ..... B41J 15/04

[52] U.S. Cl. ..... 400/613.2; 493/411

[58] Field of Search ..... 400/613.2, 613.3, 400/613.4; 493/410, 411, 412, 413, 414, 455

[56] References Cited

U.S. PATENT DOCUMENTS

| | | | |
|---|---|---|---|
| 2,018,052 | 10/1935 | Caton | 400/613.2 |
| 2,779,450 | 1/1957 | Mecum et al. | 197/133 |
| 2,845,019 | 7/1958 | Stiefel | 101/96 |
| 3,134,474 | 5/1964 | Marchman | 197/133 |
| 3,514,096 | 5/1970 | Muller | 493/410 |
| 3,712,607 | 1/1973 | Ziegler et al. | 270/61 F |
| 4,530,689 | 7/1985 | Ringer, Sr. | 493/410 |
| 4,707,156 | 11/1987 | Clark | 400/613.2 |
| 4,923,188 | 5/1990 | Neir | 270/39 |
| 5,074,837 | 12/1991 | Blanton, III et al. | 493/412 |
| 5,238,316 | 8/1993 | Moore et al. | 400/613 |
| 5,300,008 | 4/1994 | Lee et al. | 400/613.2 |

OTHER PUBLICATIONS

IBM Technical Disclosure Bulletin, "Fan–Fold Paper Rack", David, vol. 4, No. 1, p. 1 Jun. 1961.

IBM Technical Disclosure Bulletin, "Stacker Device for Continuous Forms Stacking", Neer, vol. 22, No. 10, pp. 4362–4363 Mar. 1980.

*Primary Examiner*—Edgar S. Burr

*Assistant Examiner*—Amanda B. Sandusky

*Attorney, Agent, or Firm*—William L. Muckelroy; Gary N. Lipson

[57] ABSTRACT

An adjustable paper collection device constructed with an inward guiding panel and outward guiding panel facilitating the automatic folding of continuous feed printer paper during the discharge thereof for purposes of stacking. The paper collection device may be formed with or separately from a discharge area of a conventional printer and disposed immediately therebeneath. The inward guiding panel being positioned to intercept continuous feed paper from the printer and urge the continuous feed paper in a downward and inward direction; the outward guiding panel positioned to receive the continuous feed paper from the inward guiding panel and urge the continuous feed paper in an inward and downward direction relative to the printer. In this manner, the printer paper will automatically fold as the paper deposits in the basket.

3 Claims, 3 Drawing Sheets

ADJUSTABLE CONTINUOUS FEED PRINTER PAPER COLLECTION DEVICE

BACKGROUND

1. Field of the Invention

The present invention relates to an adjustable paper collection device, and more particularly, to a continuous feed printer paper collection stand adapted for automatically stacking the continuous feed paper therein.

2. Description of the Prior Art

The advent of the computer and continuous feed paper for use therewith has revolutionized the business world. Today reams of paper are produced by continuous feed printers and are collected adjacent the printer for subsequent review, analysis or other uses. Although such uses often require separation of the continuous feed paper into individual reports, the advantages of a continuous feed discharge process are widely accepted and appreciated. Sequential pages from the printer are collected in an organized fashion and may be handled and transported without concern for misjoinder of pages. Of course, the most advantageous aspect of the continuous feed discharge is the fact that paper may be fed into the printer and received from the printer with a minimum of handling and a high degree of reliability as to both the feed and the discharge relative thereto.

Paper which is being fed into a continuous feed and discharge printer is easily controlled. The paper comes from a pre-arranged folded stack and few problems, if any, result from the transfer of said paper from the paper feed area. The same cannot be said in all instances for the collection end. When printer paper is discharged from the printer it has been, by definition, unfolded, it may or may not have a tendency to properly fold itself back upon discharge from the printing unit. The large industrial printers commonly have discharge and collection areas integral with the printer such that the paper collects therein. For the smaller printers, it is not uncommon to place boxes or baskets in a region below the printer discharge area for collection, and the printer paper is simply allowed to collect and fold upon itself therein. Some reasons for irregularities in the refolding process include: Misalignment of the collect basket relative to the printer; Peculiarities in the paper; Interruptions in the printer operation; and Mishandling of the discharged paper itself can lead to irregularities in the folding process. Any of these events can result in a disorganized array of continuous feed paper received within conventional basket areas. It would be an advantage, therefore, to provide a device that virtually assures proper folding of the continuous feed printer paper following discharge from the printer to facilitate proper stacking and organization thereof.

Until recently, computer operator's only resolution was, an often awkward attempt, to coax the continuous feed paper to fold in the right direction. The operator might try to start the continuous feed paper folding correctly, hang a chain to guide the fold or simply resign him/herself to the fact that the continuous feed paper has to be refolded later. U.S. Pat. No. 5,238,316 to Moore, et al. discloses a method of urging the continuous feed paper to fold correctly. The patent does not state, but it appears from the disclosure that to practice the invention, the operator must start the first sheet over the breaker bar. Therefore, the operator is required to be present until the first sheet of the continuous feed paper lays over the breaker bar, or in the alternative, to form feed the continuous feed paper until the first sheet of continuous feed paper is in place over the bar.

The present invention is an improvement over the Moore invention in that the present invention is functional upon installation. In addition, the present invention works with all sizes of continuous feed paper with minimum adjustments.

The present invention addresses such improved printer paper collection systems by providing an inward guiding panel and outward guiding panel which may be integrally formed with, or disposed adjacent to, a continuous feed printer for the collection of paper therefrom. The improved collection structure includes a pivotally attached and vertically adjustable inward guiding panel which urges the continuous feed paper in a downward and inward direction relative to the printer, and a pivotally attached and vertically adjustable outward guiding panel which receives the discharge from the inward guiding panel, directing the continuous feed paper in a downward and inward direction relative to the printer to ensure the proper folded configuration thereover. In this manner physical interruptions of the printer paper itself will not adversely effect the organized folding and stacking of the discharged paper. As such, maximum effectiveness of the continuous feed system can then be realized.

SUMMARY

The present invention relates to an adjustable paper collection device having means formed therewith for passive folding of the paper therein.

More particularly, the above described invention comprises an inward guiding panel. The inward guiding panel is angled downward and toward the printer so as to engage the discharge of the continuous feed paper from the printer. The continuous feed paper is directed to a second element, an outward guiding panel. The outward guiding panel is angled downward and away from the printer so as to receive and engage the discharge of continuous feed paper from the inward guiding panel. The outward guiding panel induces adjacent layers of continuous feed paper to fold thereupon in sequentially induced folding steps commensurate with the organized stacking of the printer paper.

The declination of the inward guiding panel should be from about 70 to 80 degrees relative to the horizontal. The declination of the outward guiding panel should be from the 40 to 60 degrees relative the horizontal. The device functions best when the inward guiding platform is angled at 75 degrees relative to the horizontal and the outward guiding platform is angled at 50 degrees relative to the horizontal.

In another embodiment, the above described invention includes an accepting means comprised of a platform, positioned to receive the continuous feed paper from the printer. The platform serves as to guide the discharge of the continuous feed paper from the printer to the first element of the invention.

In another embodiment, the above described invention further includes a back wall panel. Each element of the invention is attached to the back wall panel in such a manner to permit vertical adjustment and angle of declination. The back wall panel further provides support allowing the invention to be constructed as a single unit.

In yet another embodiment, the invention includes an improved printer paper collection basket of the type wherein a container is disposed beneath a continuous feed paper printer platform for receipt of paper discharged therefrom, the improvement comprising first and second upstanding walls adjustabley disposed one to the other, for facilitating the size of paper to be received from the printer and means disposed between the adjustable walls for inducing the paper to fold upon itself and stack therein.

The basket may be formed integrally with the printer stand or may be separately constructed for positioning adjacent thereto. In either configuration, the size and shape of the basket may be adjusted for facilitating utilization with various continuous feed paper sizes and preferential folding configurations thereof.

BRIEF DESCRIPTION OF THE DRAWINGS

For a more complete understanding of the present invention and for further objects and advantages thereof, reference may now be had to the following description taken in conjunction with he accompanying drawings in which.

DETAILED DESCRIPTION

Figure 1:
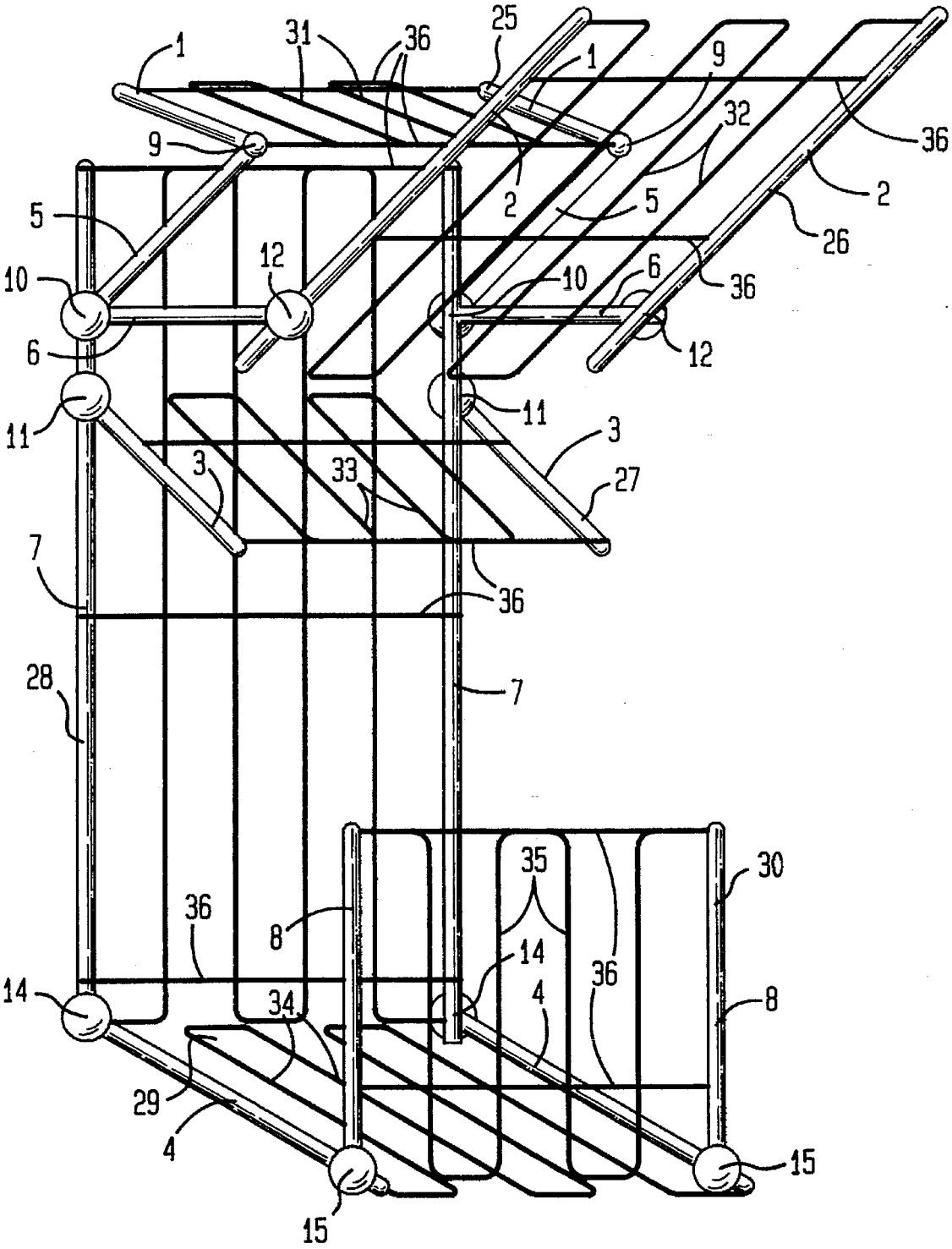
FIG. 1 is a perspective view of an adjustable paper collection device constructed in accordance with the principles of the present invention and constructed as a single integral device illustrating the receipt of continuous feed paper therein.

Referring to FIG. 1, there is shown a perspective view of a continuous feed printer paper collection stand and paper collection basket, integrally formed therewith, constructed in accordance with the principles of the present invention.

In this configuration a back wall panel 28 comprised of extended angulated wire members 35, reinforced by a plurality of horizontal wire members 36. The horizontal wire members 36 having two ends, with one end affixed to one support rod 7 and the other end affixed to the other support rod 7.

A base 29 comprised of extended angulated wire members 34 The angulated wire members 34 being connected to two support rods 4. Two fasteners 14 connecting one end of each support rod 7 to one end of each support rod 4.

A frontal wall panel 30 includes an angulated wall section comprised of extended angulated wire members 35, reinforced by a plurality of horizontal wire members 36. The frontal wall panel 30 further including two support rods 8. The horizonal wire members 36 having two ends, with one end affixed to one support rod 8 and the other end affixed to the other support rod 8, thus forming the front panel. Two fasteners 15 connecting one end of each support rod 4 to the bottom end of each of support rod 8.

The combination of frontal wall panel 30, base 29 and back wall panel 28 forms a collection basket providing a guide for the final collection of the continuous feed paper.

A platform 25 comprised of extended angulated wire members 35, reinforced by a plurality of horizontal wire members 36. The horizontal wire members 36 having two ends, with one end affixed to one support rod 1 and the other end affixed to the other support rod 1. Two rods 5 connected at one end with fastener 9 to one end of each of support rod 1, and the other end of each rod 5 connected by fastener 10 to support rod 7.

An inward guiding panel 26 comprised of extended angulated wire members 32, reinforced by a plurality of horizontal wire members 36. The horizontal wire members 36 having two ends, with one end affixed to one support rod 2 and the other end affixed to the other support rod 2. Two rods 6 connected at one end with fastener 12 to one end of each of support rod 2, and the other end of each rod 6 connected by fastener 10 to support rod 7.

An outward guiding panel 27 comprised of extended angulated wire members 33, reinforced by a plurality of horizontal wire members 36. The horizontal wire members 36 having two ends, with one end affixed to one support rod 3 and the other end affixed to the other support rod 3. Each support rod 3 connected at one end with fastener 11 to support rod 7.

Figure 2:
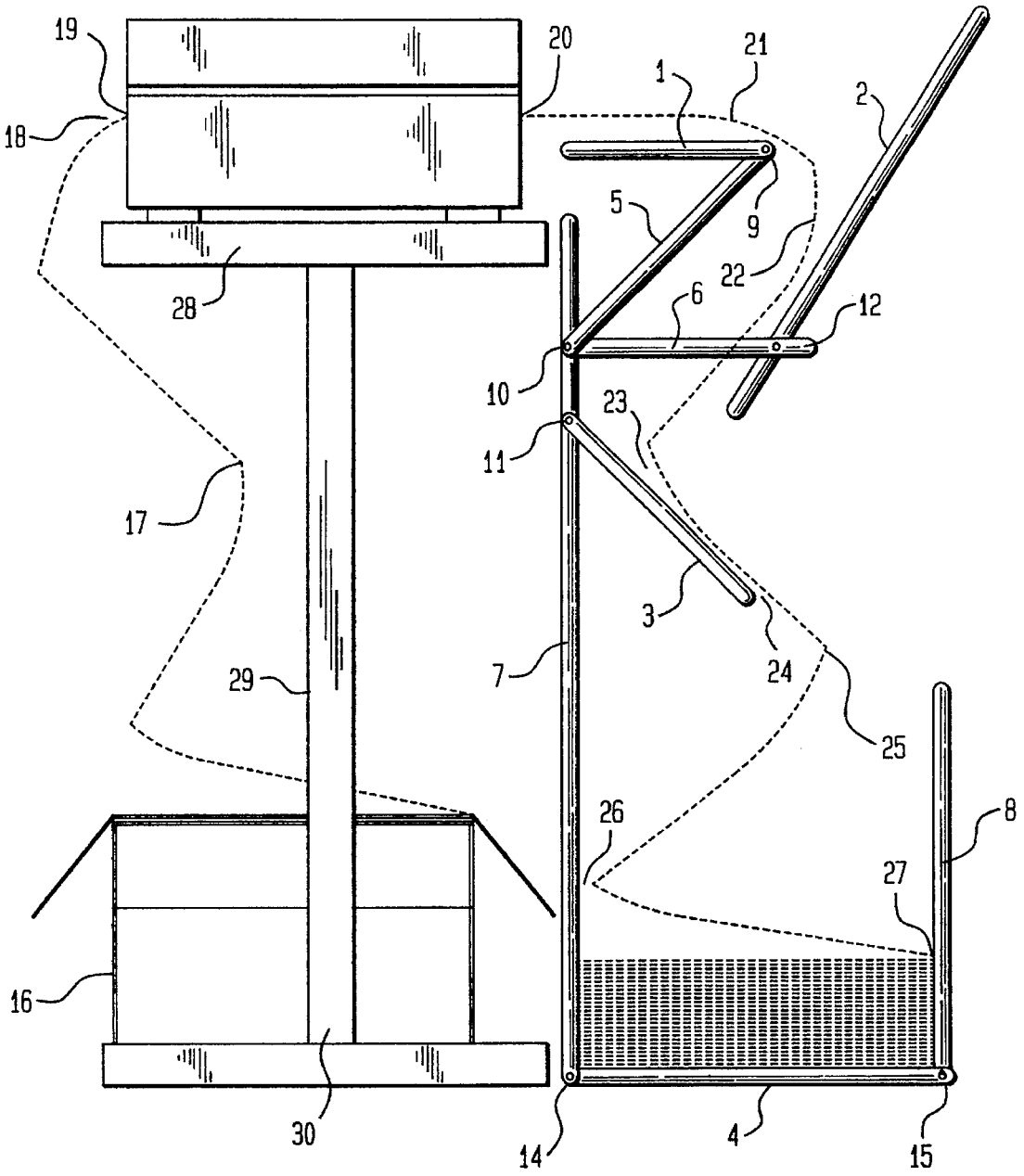
FIG. 2 is a side view of the invention of FIG. 1 illustrating in more detail the means for passively folding of the continuous feed paper therein.

Referring to FIG. 2, there is shown a perspective view of a continuous feed printer paper collection stand as it would appear in a typical practice of the invention described herein.

A pedestal 30, a support member 29 and a printer platform 28. One end of support member 29 attached to the top surface of the pedestal 30 and the other end of the support 29 attached to the bottom surface of the printer platform 28.

A platform 1. Support rods 5 being fastened at one end of platform 1 forming a joint at 9. A back wall panel 7. The other end of support rods 5 being fastened to back wall 7 forming joint 10.

An inward guiding panel 2 positioned at an inward angle relative to the printer 19. Support rods 6 having two ends. One end of support rods 6 being fastened to inward guiding panel 2 forming joint 12. The other end of support rods 6 fastened to the back wall panel 7 forming and part of joint 10.

An outward guiding panel 3 attached to the back wall panel 7 forming joint 11. The outward guiding panel 3 positioned at an outward angle relative to the printer 19.

A base 4 and a frontal wall panel 8. The base 4 attached to the frontal wall panel 8 forming joint 15. The base 4 attached to the back wall panel 7 forming joint 14. The base 4, frontal wall panel 8 and back wall panel 7 forming a cavity to permit the collection of continuous feed paper.

The printer 19 resting on the top surface of platform 28. A supply of continuous feed paper 16 resting on the top surface of the pedestal 30. The supply of continuous feed paper 16 travels upward at 17 to the entry point 18 of the printer 19. The continuous feed paper is discharged from the printer 19 at exit point 20.

The continuous feed paper discharge 20 travels on top of platform 1 at 21. The continuous feed paper discharge 21 accepted at platform 1 is received at inward guiding panel 2, the continuous feed paper urged downward and inward at 22. The continuous feed paper discharge at 22 is received by the outward guiding panel 3 at 23. The continuous feed paper received by the outward guiding panel 3 is directed downward and outward at 24.

The continuous feed paper folds inward along perforation at 25. The continuous feed paper folds along its perforations resting in the cavity at 26 and 27.

Figure 3:
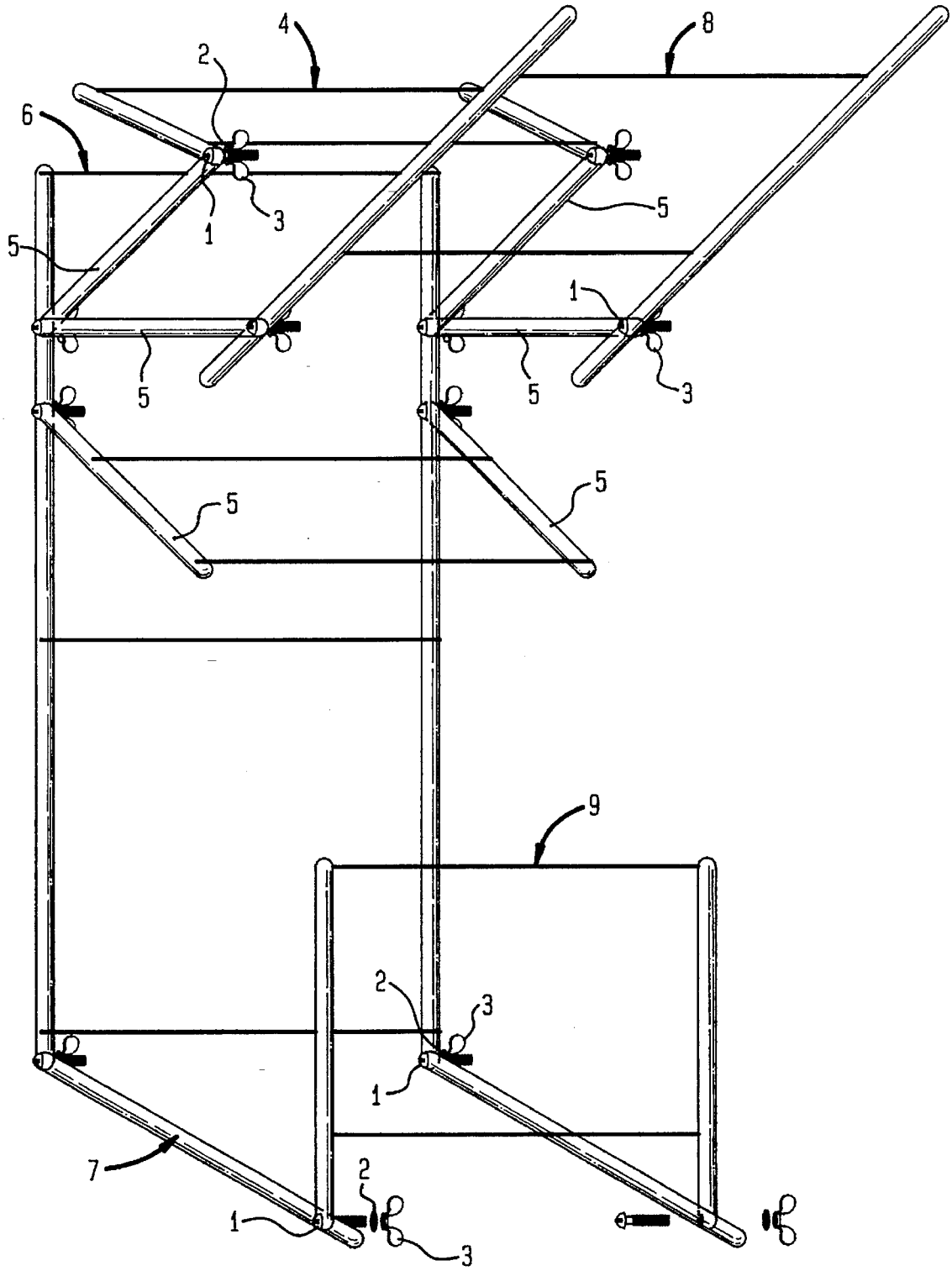
FIG. 3 is a perspective view of the invention of FIG. 1 illustrating in more detail one contemplated method of fastening together elements of the invention.

Referring to FIG. 3, there is shown a perspective view of a continuous feed printer paper collection stand and paper collection basket, integrally formed therewith, constructed in accordance with the principles of the present invention. The dimensions represented herein are only one embodiment, the actual practice of the invention is represented by dimensions that are both larger and small as those represented herein. FIG. 3 shows an embodiment of the invention as represented in both FIG. 1 and FIG. 2 such that all joints referred to in FIG. 1 and FIG. 2 comprise:

A 1.5 inch screw 1, a washer 2 and a wing nut 3. The wing nut 3 hand tightened so as to provide an ability to change the position of the member parts to accommodate the particular printer or continuous feed paper being used therewith.

The platform 4 being 1'4" wide and 6" long. The support rods 5 having a length of 7'. The back wall panel 6 having a height of 2'5" and a width of 1'4". The base 7 being 1'4" wide and 11" long. The inward guiding panel 8 being 1'4" wide and 1'long. Finally the frontal wall panel 9 being 1'4" wide and 1'4" high.

What is claimed is:

1. An adjustable paper collection device for the collection of continuous feed paper from a printer, the adjustable paper stand comprising:

a back wall panel, a platform and two rods, one end of each rod pivotally connected to the platform, the other end of each rod adjustabley and pivotally connected to the back wall panel permitting vertical and declination adjustment, the platform positioned to receive continuous feed paper from the printer;

an inward guiding panel and two rods, one end of each rod pivotally attached to one corner of the inward guiding panel, the other end of each rod adjustably and pivotally connected to the back wall panel permitting vertical and declination adjustment, the inward guiding panel positioned to receive the discharge of the continuous feed paper from the platform, the inward guiding panel angled downward and inward toward the printer, the inward guiding panel having an angle of declination from about 70 to 80 degrees relative to the horizontal;

an outward guiding panel having two sides, each side of the outward guiding panel adjustabley and pivotally connected to the back wall panel permitting vertical and declination adjustment, the outward guiding panel positioned to receive the discharge of the continuous feed paper from the inward guiding panel, the outward guiding panel angled downward and away from the printer, the outward guiding panel having an angle of declination from about 40 to 60 degrees relative to the horizontal; and a basket having a base and front wall panel, the back wall panel having a posterior end, the base having four corners, the front wall panel having two bottom corners, two corners of the base fastened to the posterior end of the back wall, the other two corners of the base slidably connected to the two bottom corners of the front wall permitting a variable distance between the front wall panel and the back wall in order to accommodate continuous feed paper of different sizes.

2. An improved adjustable paper collection device of the type comprising a means for passing continuous feed paper discharged from a printer downward toward a collection basket, the improvement comprising:

an accepting means including a platform for receiving discharge of the continuous feed paper from the printer;

an inward guiding panel, the inward guiding panel positioned to receive the discharge of the continuous feed paper from the accepting means, the inward guiding panel having an angle of declination from about 70 to 80 degrees relative to the horizontal, the inward guiding panel positioned at an inward angle relative to the discharge of the continuous feed paper to engage the discharge of the continuous feed printer paper from the accepting means and urge the continuous feed paper in a downward direction; and an outward guiding panel having an angle of declination from about 40 to 60 degrees relative to the horizontal, the outward guiding panel positioned below the inward guiding panel, the outward guiding panel positioned to engage the continuous feed paper discharged from the inward guiding panel, the outward guiding panel being in a downward position such that the discharge is encouraged to fold along perforated lines;

a back wall panel having an anterior portion, a first connecting means for connecting the platform to the anterior portion, the platform positioned to accept discharge of the continuous feed paper from the printer, a second connecting means for connecting the inward guiding panel to the back wall, a third connecting means for connecting the outward guiding panel to the back wall; and a collection means for collecting the continuous feed paper as the continuous feed paper is discharged form the outward guiding panel, the collection means comprising a frontal wall panel and a base, the frontal wall and back wall panel oppositely opposed on each side of the base defining a cavity therein to permit receipt of the continuous feed paper.

3. An adjustable paper collection device as claimed in claim 2, wherein the frontal wall panel is adjustable relative to the back wall panel defining one side of the collection means accommodating different sizes of continuous feed paper received therein.

* * * * *